US009311894B2

(12) United States Patent
Lin et al.

(10) Patent No.: US 9,311,894 B2
(45) Date of Patent: Apr. 12, 2016

(54) LIQUID CRYSTAL DISPLAY APPARATUS AND METHOD FOR DISPLAYING PICTURES

(71) Applicants: BOE Technology Group Co., Ltd., Beijing (CN); Beijing BOE Display Technology Co., Ltd., Beijing (CN)

(72) Inventors: Lifeng Lin, Beijing (CN); Hongming Zhan, Beijing (CN); Yongcan Wang, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 0 days.

(21) Appl. No.: 14/314,723

(22) Filed: Jun. 25, 2014

(65) Prior Publication Data

US 2015/0279331 A1 Oct. 1, 2015

(30) Foreign Application Priority Data

Mar. 31, 2014 (CN) ..... 2014 1 0126437

(51) Int. Cl.

| | |
|---|---|
| ***G09G 5/18*** | (2006.01) |
| ***G09G 5/10*** | (2006.01) |
| ***G09G 3/36*** | (2006.01) |
| ***G09G 5/02*** | (2006.01) |
| ***G09G 3/20*** | (2006.01) |

(52) U.S. Cl.

CPC ..... *G09G 5/18* (2013.01); *G09G 3/2022* (2013.01); *G09G 3/3685* (2013.01); *G09G 5/02* (2013.01); *G09G 5/10* (2013.01)

(58) Field of Classification Search

CPC ..... G09G 5/18; G09G 3/3685; G09G 5/02; G09G 5/10; G09G 3/2018–3/204

USPC ..... 345/87–100, 690–699

See application file for complete search history.

(56) References Cited

U.S. PATENT DOCUMENTS

| | | | | |
|---|---|---|---|---|
| 8,395,644 | B2 * | 3/2013 | Son et al. | 345/690 |
| 2002/0113764 | A1 * | 8/2002 | Yamada et al. | 345/88 |
| 2008/0094541 | A1 * | 4/2008 | Ma et al. | 349/69 |
| 2010/0289834 | A1 * | 11/2010 | Lee et al. | 345/690 |
| 2012/0313985 | A1 * | 12/2012 | Gotoh | 345/691 |
| 2014/0192079 | A1 * | 7/2014 | Lee et al. | 345/597 |

FOREIGN PATENT DOCUMENTS

| | | | |
|---|---|---|---|
| CN | 102025952 | A | 4/2011 |
| CN | 102629450 | A | 8/2012 |

OTHER PUBLICATIONS

First Office Action, including Search Report, for Chinese Patent Application No. 201410126437.X, dated Jan. 28, 2016, 10 pages.

* cited by examiner

*Primary Examiner* — Dmitriy Bolotin

(74) *Attorney, Agent, or Firm* — Westman, Champlin & Koehler, P.A.

(57) ABSTRACT

A liquid crystal display apparatus and a method for displaying pictures are provided. The liquid crystal display apparatus comprises P kinds of sub-pixels with different colors, wherein P is an integer more than 1. The method comprises displaying each picture at a display period of N frames. N is an integer greater than or equal to 2, and the sub-pixels with any one of Q colors are displayed in normal state in the display period of each picture, wherein Q is an integer, 0<Q<P, and in the display period of each picture, the sub-pixels with the color other than the Q colors are displayed in dark state in at least one frames and are displayed in normal state in the other frames. The number of the frames in which the sub-pixels with the color other than the Q colors are displayed in normal state is at least one.

8 Claims, 1 Drawing Sheet

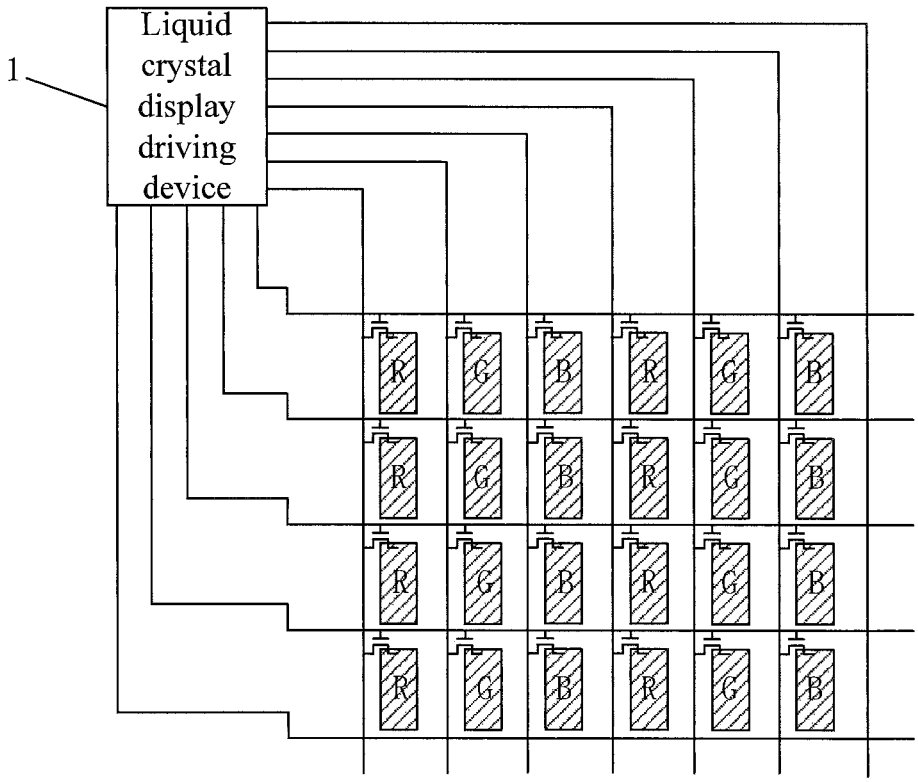
1
Liquid crystal display driving device
R
G
B

LIQUID CRYSTAL DISPLAY APPARATUS AND METHOD FOR DISPLAYING PICTURES

CROSS-REFERENCE TO RELATED APPLICATION

This application claims the benefit of Chinese Patent Application No. 201410126437.X filed on Mar. 31, 2014 in the State Intellectual Property Office of China, the whole disclosure of which is incorporated herein by reference.

BACKGROUND OF THE INVENTION

1. Field of the Invention

The present disclosure relates to a technical field of liquid crystal display, more particularly, relates to a liquid crystal display apparatus and a method for displaying pictures.

2. Description of the Related Art

There are several types of sub-pixels with various colors, such as the red sub-pixel R, the green sub-pixel G and the blue sub-pixel B, in a liquid crystal display apparatus. Color coordinate configuration of the sub-pixels with different colors may show expressive intensity of colors of the liquid crystal display apparatus. The color coordinates of chroma of a mixed light formed by the sub-pixels with different colors are associated with relative luminance of the respective sub-pixels. If some sub-pixels have insufficient luminance, the deviation of color coordinates of the mixed light formed by the sub-pixels with the respective colors will occur. The deviation typically may be suppressed by means of correcting the color coordinate of the white light to the standard value by regulating the chroma of the background light source. However, if the deviation is relative large, it will be impossible to correct the color coordinate of the white light to the standard value.

For example, different standards of color ranges correspond to different expressive intensity of colors. An established solution has been proposed for the liquid crystal display apparatus corresponding to the standard of color ranges of sRGB100%, as illustrated in Table 1. The color coordinates of the standard of color ranges of sRGB100% and the standard of color ranges of adobe100% are arranged as follows:

TABLE 1

| | standard of color ranges | | | |
|---|---|---|---|---|
| | adobe100% | | sRGB100% | |
| Color coordinate | x | y | x | y |
| R color coordinate value of red sub-pixels | 0.640 | 0.330 | 0.640 | 0.330 |
| G color coordinate value of green sub-pixels | 0.210 | 0.710 | 0.300 | 0.600 |
| B color coordinate value of blue sub-pixels | 0.150 | 0.060 | 0.150 | 0.060 |

It can be seen from table 1 that the G color coordinate value of green sub-pixel needs to be changed if the standard of color ranges is improved from sRGB100% to adobe100%. However, it may reduce the transmittance of the green sub-pixels G significantly. The significant reduction of the transmittance of the green sub-pixels G will cause a serious effect on the coordinate of the mixed white light, and thus it will be difficult to correct the color coordinate of the white light to the standard value after the green sub-pixels G are updated.

SUMMARY OF THE INVENTION

The present disclosure provides a liquid crystal display apparatus and a method for displaying pictures. With the relative luminance of some color sub-pixels improved, the deviation of the color coordinate of the white light caused by low transmittance of such sub-pixels can be reduced.

In order to solve the above technical problem, the present disclosure may be implemented by the following technical solutions.

According to an aspect of the present disclosure, there is provided a method for displaying pictures on a liquid crystal display apparatus, the liquid crystal display apparatus comprising P kinds of sub-pixels with different colors, wherein P is an integer more than 1, the method comprising:

displaying each picture at a display period of N frames on the liquid crystal display apparatus, wherein N is an integer greater than or equal to 2, and wherein the sub-pixels with any one of Q colors are displayed in normal state in the display period of each picture, wherein Q is an integer, $0<Q<P$, and in the display period of each picture, the sub-pixels with the color other than the Q colors are displayed in dark state in at least one frames and are displayed in normal state in the frames other than the at least one frames, wherein the number of the frames in which the sub-pixels with the color other than the Q colors are displayed in normal state is at least one, and wherein the sub-pixels in dark state have lower luminance than those in normal state.

According to another aspect of the present disclosure, there is provided a liquid crystal display apparatus, comprising:

P kinds of sub-pixels with different colors, wherein P is an integer more than 1;

a liquid crystal display driving device configured to transmit data signals to the respective sub-pixels to drive them to display pictures, the liquid crystal display driving device being adapted to display each picture at a display period of N frames on the liquid crystal display apparatus, wherein N is an integer greater than or equal to 2, and wherein the liquid crystal display driving device is further configured to display the sub-pixels with any one of Q colors in normal state in the display period of each picture, wherein Q is an integer, $0<Q<P$, and wherein the liquid crystal display driving device is further configured to, in the display period of each picture, display the sub-pixels with the color other than the Q colors in dark state in at least one frames and in normal state in the frames other than the at least one frames, wherein the number of the frames where the sub-pixels with the color other than the Q colors are displayed in normal state is at least one, and wherein the sub-pixels in dark state have lower luminance than those in normal state.

BRIEF DESCRIPTION OF THE DRAWINGS

The above and other features of the present invention will become more apparent by describing in detail exemplary embodiments thereof with reference to the accompanying drawings, in which:

FIG. 1 is an illustrative structure view of a liquid crystal display apparatus according to an embodiment of the present invention.

DETAILED DESCRIPTION OF PREFERRED EMBODIMENTS OF THE INVENTION

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

According to a general concept of the present invention, there is provided a method for displaying pictures on a liquid crystal display apparatus, the liquid crystal display apparatus comprising P kinds of sub-pixels with different colors, wherein P is an integer more than 1, the method comprising: displaying each picture at a display period of N frames on the liquid crystal display apparatus, wherein N is an integer greater than or equal to 2, and wherein the sub-pixels with any one of Q colors are displayed in normal state in the display period of each picture, wherein Q is an integer, $0<Q<P$, and in the display period of each picture, the sub-pixels with the color other than the Q colors are displayed in dark state in at least one frames and are displayed in normal state in the frames other than the at least one frames, wherein the number of the frames in which the sub-pixels with the color other than the Q colors are displayed in normal state is at least one, and wherein the sub-pixels in dark state have lower luminance than those in normal state.

According to a general concept of the present invention, there is provided a liquid crystal display apparatus, comprising: P kinds of sub-pixels with different colors, wherein P is an integer more than 1; a liquid crystal display driving device configured to transmit data signals to the respective sub-pixels to drive them to display pictures, the liquid crystal display driving device being adapted to display each picture at a display period of N frames on the liquid crystal display apparatus, wherein N is an integer greater than or equal to 2, and wherein the liquid crystal display driving device is further configured to display the sub-pixels with any one of Q colors in normal state in the display period of each picture, wherein Q is an integer, $0<Q<P$, and wherein the liquid crystal display driving device is further configured to, in the display period of each picture, display the sub-pixels with the color other than the Q colors in dark state in at least one frames and in normal state in the frames other than the at least one frames, wherein the number of the frames in which the sub-pixels with the color other than the Q colors are displayed in normal state is at least one, and wherein the sub-pixels in dark state have lower luminance than those in normal state.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As illustrated in FIG. 1, the liquid crystal display driving device transmits data signals into the respective sub-pixels, such as red sub-pixels, green sub-pixels and blue sub-pixels, respectively to allow the respective sub-pixels to form a desired picture to be displayed. Displaying the sub-pixels in normal state means that the sub-pixels receive the data signals for displaying a desired picture to make the liquid crystal molecules deflect normally as required so as to perform a desired gray scaling display. Displaying the sub-pixels in dark state means that the sub-pixels receive dark state data signals to make the liquid crystal molecules deflect in a specific manner to mask the light so as to achieve a display luminance lower than that in normal state, for example, the light may be masked partly or completely.

Specifically, in the conventional liquid crystal display apparatus, typically, one frame is used as the display period of each picture, that is, each frame data lines output the data signals for one picture. In contrast, in the method for displaying pictures provided by the present embodiment, each picture is displayed by combination of N frames, that is, in every N frames, the data signals received by the sub-pixels displayed in normal state are those for one same picture. As an example, in the N frames, one same sub-pixel receives the same data signals in every frame in which the sub-pixel is displayed in normal state. In the N frames, each sub-pixel is displayed in normal state at least in one frame to form the picture. Some sub-pixels are displayed in normal state in all of frames, and the other sub-pixels are displayed in dark state in at least one frame. For example, sub-pixels with a certain color in the sub-pixels with Q colors have relative low transmittance to affect the color coordinate of the white light formed by mixture. In the N frames, the sub-pixels with such color are displayed in normal state for the longest time among all of the sub-pixels with various colors, and thus during displaying the picture, the sub-pixels with such color will have an improved relative luminance such that the problem that the sub-pixels with such color has a lower transmittance can be alleviated to some extent.

As an example, in the display period of each picture, for the sub-pixels with the color other than the Q colors, the data signals received by one sub-pixel in the frame in which it is displayed in normal state may be different from the data signals received by the same sub-pixel in the frame in which it is displayed in dark state.

In the method for displaying pictures for the liquid crystal display apparatus, by combining every N frames to display one picture and displaying the sub-pixels with a certain color in normal state for the longest time among all of the sub-pixels with various colors, the relative luminance of the sub-pixels with such color is improved upon displaying the picture such that the problem that the sub-pixels with such color has a lower transmittance can be alleviated to some extent, thereby reducing the deviation of color coordinate of white light caused by lower transmittance of the sub-pixels with such color.

As an example, the liquid crystal display apparatus may have a scanning frequency of $(60\times N)$ Hz. The typical scanning frequency of the liquid crystal display apparatus is 60 Hz. If the scanning frequency is lower than 60 Hz, the human eye may feel flashing significantly. In the present embodiment, as one picture is displayed by combining every N frames, the minimum time in which the sub-pixels are displayed in normal state in one picture is one frame. Thus, in order to avoid flashing, it needs relative high scanning frequency. Certainly, the scanning frequency is not limited to $(60\times N)$ Hz. A scanning frequency higher than the frequency may also be used, for example, if $N=2$, the scanning frequency of 150 Hz or 180 Hz may be used.

As an example, the P kinds of sub-pixels with different colors may include red sub-pixels R, green sub-pixels G and blue sub-pixels B. They are typical combination of different colors of the sub-pixels. Certainly, other kinds of color combination of the sub-pixels may also be used, for example, the P kinds of sub-pixels with different colors may include red sub-pixels R, green sub-pixels G, blue sub-pixels B and yellow sub-pixels Y.

In an example, if the standard of color ranges for the liquid crystal display apparatus with sub-pixels RGB is changed from sRGB100% to adobe100%, the color coordinate of the green sub-pixels G will need to be changed. However, it may reduce the transmittance of the green sub-pixels G significantly. In the circumstance, the sub-pixels with Q colors comprise the green sub-pixels G, and its relative luminance will be improved by increasing the relative time in which the green sub-pixels G is displayed in normal state per N frames, such that the deviation of color coordinate of white light caused by lower transmittance of the green sub-pixels G can be reduced. Certainly, the sub-pixels with the above Q colors are not limited to those comprising the green sub-pixels. Sub-pixels with any colors may be used in the present embodiment as any of the sub-pixels with the above Q colors if their reduced transmittance causes the deviation of color coordinate of the white light.

The method for displaying pictures for the liquid crystal display apparatus according to the embodiment will be further explained below with reference to examples.

The liquid crystal display apparatus comprises red sub-pixels R, green sub-pixels G and blue sub-pixels B. As its standard of color ranges is changed from sRGB100% to adobe100%, the color coordinate of the green sub-pixels G is changed such that the color coordinate of the white light formed by mixture can have relative large deviation due to reduced transmittance of the green sub-pixels G.

TABLE 2

| Standard of color ranges | | sRGB100% | Adobe100% |
|---|---|---|---|
| Color coordinate of the red sub-pixels | Rx | 0.640 | 0.640 |
| | Ry | 0.330 | 0.330 |
| Transmittance of the red sub-pixels | RY | 0.180 | 0.180 |
| Color coordinate of the green sub-pixels | Gx | 0.300 | 0.210 |
| | Gy | 0.600 | 0.710 |
| Transmittance of the green sub-pixels | GY | 60.0% | 24.0% |
| Color coordinate of the blue sub-pixels | Bx | 0.150 | 0.150 |
| | By | 0.060 | 0.060 |
| Transmittance of the blue sub-pixels | BY | 6.0% | 6.0% |
| Color coordinate of the white light formed by mixture | Wx | 0.314 | 0.303 |
| | Wy | 0.330 | 0.255 |
| Transmittance of the white light formed by mixture | WY | 28.0% | 16.0% |

For example, for the color coordinate and transmittance of the red, green and blue sub-pixels meeting the standards of color ranges of sRGB100% and Adobe100%, as shown in Table 2, the significant reduction of the transmittance of the green sub-pixels causes the relative large deviation of the color coordinate of the white light.

In this circumstance, one picture is displayed by combining every N frames, N=2, 3 or 4. In the N frames, all of the data lines output data signals for the same picture. When the scanning frequency of the liquid crystal display apparatus is (60×N) Hz, the characteristics of color coordinate of the white light as shown in Table 3 can be achieved by combining the frames in which the sub-pixels RGB are displayed in normal state per N frames.

TABLE 3

| N | 1 | 2 | 2 | 3 | 3 | 4 | 4 |
|---|---|---|---|---|---|---|---|
| Number of frames in which R/G/B are displayed in normal state | 1/1/1 | 1/2/1 | 2/2/1 | 2/3/2 | 3/3/2 | 3/4/2 | 3/4/3 |
| Color coordinate of the white light Wx | 0.303 | 0.289 | 0.358 | 0.295 | 0.336 | 0.327 | 0.297 |
| Color coordinate of the white light Wy | 0.255 | 0.324 | 0.325 | 0.292 | 0.297 | 0.325 | 0.281 |
| Wx − 0.313 | −0.010 | −0.024 | 0.045 | −0.018 | 0.023 | 0.014 | −0.016 |
| Wy − 0.329 | −0.074 | −0.005 | −0.004 | −0.037 | −0.032 | −0.004 | −0.048 |

In Table 3, Wx and Wy represent the color coordinates of the white light, and (Wx−0.313, Wy−0.329) represent the deviation between the color coordinate of the white light and the standard value. It should be noted that Table 3 only shows the number of frames in which R/G/B are displayed in normal state. In the frames in which the sub-pixels are not displayed in normal state, the sub-pixels are displayed in dark state. It can be seen from Table 3 that:

(1) If N=1, it represents characteristics of color coordinates of the conventional liquid crystal display apparatus, and in this circumstance, the display period of every picture is one frame and all of the sub-pixels RGB are displayed in normal state in all of frames, in this example, the deviation of the color coordinate of the white light is (−0.010, −0.074), which is too large to correct the color coordinate of the white light to the numerical range in conformity with the standard by regulating the chroma of the background light source.

(2) If N=2, the liquid crystal display apparatus uses the scanning frequency of 120 Hz, in this circumstance, the display period of every picture is two frames, and in the two frames, the number of frames, in which R/G/B sub-pixels are displayed in normal state, of "1/2/1" means that the green sub-pixels G are displayed in normal state in every frame while the red sub-pixels R and the blue sub-pixels B are displayed in normal state in one of the two frames and in dark state in the other one, and in this example, the deviation of the color coordinate of the white light is (−0.024, −0.005), which is reduced significantly in comparison with the deviation of the color coordinate of the white light of (−0.010, −0.074) of the conventional liquid crystal display apparatus and may be corrected to the standard value by regulating the chroma or color block of the background light source. Similarly, when the number of frames in which R/G/B sub-pixels are displayed in normal state is "2/2/1", the deviation of the color coordinate of the white light is (0.045, −0.004), which is also relative small and may also be corrected to the standard value by regulating the chroma or color block of the background light source.

(3) If N=3, the liquid crystal display apparatus uses the scanning frequency of 180 Hz, in this circumstance, the display period of every picture is three frames, and in the three frames, when the number of frames in which R/G/B sub-pixels are displayed in normal state is "2/3/2", the deviation of the color coordinate of the white light is (−0.018, −0.037), and specifically, in this circumstance, only the number of frames in which the red sub-pixels R and the blue sub-pixels B are displayed in normal state is defined as 2, but which two frames in the three frames are displayed in normal state is not defined; when the number of frames in which R/G/B sub-pixels are displayed in normal state is "3/3/2", the deviation of the color coordinate of the white light is (0.023, −0.032). The above two deviations are both small in comparison with the deviation of the color coordinate of the white light of the conventional liquid crystal display apparatus and may be corrected to the standard value by regulating the chroma of the background light source.

(4) If N=4, the liquid crystal display apparatus uses the scanning frequency of 240 Hz, in this circumstance, the display period of every picture is four frames, and in the four frames, when the number of frames in which R/G/B sub-pixels are displayed in normal state is "3/4/2", the deviation of the color coordinate of the white light is (0.014, −0.004); when the number of frames in which R/G/B sub-pixels are displayed in normal state is "3/4/3", the deviation of the color coordinate of the white light is (−0.016, −0.048). The above two deviations are both small in comparison with the deviation of the color coordinate of the white light of the conventional liquid crystal display apparatus and may be corrected to the standard value by regulating the chroma of the background light source.

It should be noted that although the above embodiments are explained with reference to the examples of N=2, 3, 4, N may also be equal to an integer more than 4. In addition, although only six combination form of frames in which R/G/B are displayed in normal state are exemplified, the embodiments of the present disclosure are not limited to the above six combination form of frames in which R/G/B are displayed in normal state.

In the method for displaying pictures for the liquid crystal display apparatus according to the embodiments, by combining every N frames to display one picture and displaying the sub-pixels with a certain color in normal state for the longest time among all of the sub-pixels with various colors, the relative luminance of the sub-pixels with such color is improved upon displaying the picture such that the problem that the sub-pixels with such color has a lower transmittance can be alleviated to some extent, thereby reducing the deviation of color coordinate of white light caused by lower transmittance of the sub-pixels with such color.

The embodiment of the present disclosure also provides a liquid crystal display apparatus, as shown in FIG. 1, comprising: P kinds of sub-pixels with different colors, wherein P is an integer more than 1. The liquid crystal display apparatus further includes a liquid crystal display driving device 1 configured to transmit data signals to the respective sub-pixels such as red, green, blue sub-pixels, respectively to drive them to display the desired pictures. The liquid crystal display driving device 1 is adapted to display each picture at a display period of N frames, wherein N is an integer greater than or equal to 2, and wherein the liquid crystal display driving device is further configured to display the sub-pixels with any one of Q colors in normal state in the display period of N frame for each picture, wherein Q is an integer, 0<Q<P, and wherein the liquid crystal display driving device 1 is further configured to, in the display period of N frame, display the sub-pixels with the color other than the Q colors in dark state in at least one frames and in normal state in the frames other than the at least one frames, wherein the number of the frames in which the sub-pixels with the color other than the Q colors are displayed in normal state is at least one.

As an example, the above liquid crystal display apparatus may have a scanning frequency of (60×N) Hz or more.

As an example, the above P kinds of sub-pixels with different colors may be red sub-pixels R, green sub-pixels G and blue sub-pixels B.

As an example, the above sub-pixels with Q colors may comprise green sub-pixels G.

The method for displaying pictures for the above liquid crystal display apparatus has the same principles as those of the above embodiments. Thus, the specific description will be omitted.

With the liquid crystal display apparatus and the method for displaying pictures according to the embodiments of the present disclosure, by combining every N frames to display one picture and displaying the sub-pixels with a certain color in normal state for the longest time among all of the sub-pixels with various colors, the relative luminance of the sub-pixels with such color is improved upon displaying the picture such that the problem that the sub-pixels with such color has a lower transmittance can be alleviated to some extent, thereby reducing the deviation of color coordinate of white light caused by lower transmittance of the sub-pixels with such color.

Although several exemplary embodiments have been shown and described, the present invention is not limited to those and it would be appreciated by those skilled in the art that various changes or modifications may be made in these embodiments without departing from the principles and spirit of the disclosure, the scope of which is defined in the claims and their equivalents.

What is claimed is:

1. A method for displaying pictures for a liquid crystal display apparatus, the liquid crystal display apparatus comprising P kinds of sub-pixels with different colors, wherein P is an integer more than 1, the method comprising:

displaying each picture at a display period of N frames on the liquid crystal display apparatus, wherein N is an integer greater than or equal to 2, and wherein the sub-pixels with any one of Q colors are displayed in normal state in the display period of each picture, wherein Q is an integer, O<Q<P, and in the display period of each picture, the sub-pixels with the color other than the Q colors are displayed in dark state in at least one frames and are displayed in normal state in the frames other than the at least one frames, wherein the number of the frames in which the sub-pixels with the color other than the Q colors are displayed in normal state is at least one, and wherein the sub-pixels in dark state have lower luminance than those in normal state, wherein the P kinds of sub-pixels with different colors are red sub-pixels, green sub-pixels and blue sub-pixels, and the sub-pixels with the Q colors comprise green sub-pixels, and wherein all of the red sub-pixels are displayed in normal state in greater than N/2 frames in each display period.

2. The method according to claim 1, wherein, in the display period of each picture, one same sub-pixel receives same data signals in all of frames in which it is displayed in normal state.

3. The method according to claim 1, wherein, in the display period of each picture, for the sub-pixels with the color other than the Q colors, the data signals received by one sub-pixel in the frame in which it is displayed in normal state are different from the data signals received by the same sub-pixel in the frame in which it is displayed in dark state.

4. The method according to claim 1, wherein the liquid crystal display apparatus has a scanning frequency of not less than (60×N) Hz.

5. A liquid crystal display apparatus, comprising:

P kinds of sub-pixels with different colors, wherein P is an integer more than 1;

a liquid crystal display driving device configured to transmit data signals to the respective sub-pixels in order to drive them to display pictures, the liquid crystal display driving device being configured to display each picture at a display period of N frames, wherein N is an integer greater than or equal to 2, and wherein the liquid crystal display driving device is further configured to display the sub-pixels with any one of Q colors in normal state in the N frames, wherein Q is an integer, 0<Q<P, and wherein the liquid crystal display driving device is further configured to, in the display period of each picture, display the sub-pixels with the color other than the Q colors in dark state in at least one frames and in normal state in the frames other than the at least one frames, wherein the number of the frames in which the sub-pixels with the color other than the Q colors are displayed in normal state is at least one, and wherein the sub-pixels in dark state have lower luminance than those in normal state, wherein the P kinds of sub-pixels with different colors are red sub-pixels, green sub-pixels and blue sub-pixels, and the sub-pixels with the Q colors comprise green sub-pixels, and wherein all of the red sub-pixels are displayed in normal state in greater than N/2 frames in each display period.

6. The liquid crystal display apparatus according to claim 5, wherein, in the display period of each picture, one same sub-pixel receives same data signals in all of frames in which it is displayed in normal state.

7. The liquid crystal display apparatus according to claim 5, wherein, in the display period of each picture, for the sub-pixels with the color other than the Q colors, the data signals received by one sub-pixel in the frame in which it is displayed in normal state are different from the data signals received by the same sub-pixel in the frame in which it is displayed in dark state.

8. The method according to claim 5, wherein the liquid crystal display apparatus has a scanning frequency of not less than (60×N) Hz.

* * * * *